US012264404B2

(12) United States Patent
Ng et al.

(10) Patent No.: US 12,264,404 B2
(45) **Date of Patent: *Apr. 1, 2025**

(54) ENERGY EFFICIENT PRECISION MANUFACTURED CRITICAL SURFACE GUIDED LIQUID-TO-GAS CONVERSION METHOD

(71) Applicants: Charles H Ng, Palo Alto, CA (US); Hokchung Ng, Toronto (CA)

(72) Inventors: Charles H Ng, Palo Alto, CA (US); Hokchung Ng, Toronto (CA)

( * ) Notice: Subject to any disclaimer, the term of this patent is extended or adjusted under 35 U.S.C. 154(b) by 3 days.

This patent is subject to a terminal disclaimer.

(21) Appl. No.: 18/142,033

(22) Filed: May 2, 2023

(65) Prior Publication Data

US 2024/0011169 A1 Jan. 11, 2024

Related U.S. Application Data

(60) Provisional application No. 63/359,491, filed on Jul. 8, 2022.

(51) Int. Cl.

| | |
|---|---|
| ***C25B 9/63*** | (2021.01) |
| ***C25B 1/04*** | (2021.01) |
| ***C25B 9/70*** | (2021.01) |
| ***C25B 11/02*** | (2021.01) |
| ***C25B 15/08*** | (2006.01) |

(52) U.S. Cl.
CPC ..... *C25B 9/63* (2021.01); *C25B 9/70* (2021.01); *C25B 11/02* (2013.01); *C25B 15/08* (2013.01); *C25B 1/04* (2013.01)

(58) Field of Classification Search
CPC ..... C25B 11/03; C25B 11/031; C25B 11/032
See application file for complete search history.

(56) References Cited

U.S. PATENT DOCUMENTS

| | | | | |
|---|---|---|---|---|
| 2008/0053840 | A1* | 3/2008 | Arihara | C02F 1/4672 205/626 |
| 2016/0060776 | A1* | 3/2016 | Kawajiri | C25B 9/00 205/637 |
| 2020/0083541 | A1* | 3/2020 | Swiegers | H01M 8/0239 |

* cited by examiner

*Primary Examiner* — Ciel P Contreras

(57) ABSTRACT

Electron exchangers are placed vertically or horizontally in a conversion cell and divide it into cathode gas chamber, liquid chamber, and anode gas chamber. One side of the electron exchangers is conductive, and the other side is nonconductive. Voltage is applied to the electron exchangers to convert the liquid conversion solution to gases at the side of the electron exchangers facing the gas chambers, and gases are released directly to the gas chambers. The electron exchangers have many puncture channels on the surfaces, and they are designed by critical surface calculations. The puncture channels have special designed patterns and are manufactured with a precision technology. In producing the same amount of final gases, our method is energy efficient.

15 Claims, 4 Drawing Sheets

ENERGY EFFICIENT PRECISION MANUFACTURED CRITICAL SURFACE GUIDED LIQUID-TO-GAS CONVERSION METHOD

CROSS-REFERENCE TO RELATED APPLICATIONS

This application claims the benefit of Provisional Patent Application Ser. # US 63/359,491, filed Jul. 8, 2022 by the present inventors, which is incorporated by reference in its entirety.

TECHNICAL FIELD

The present invention relates to liquid to gas conversion method with an electrical voltage, specifically to such a method which is energy efficient.

BACKGROUND ART

It is known in the prior art that liquid-to-gas conversion is commonly achieved by the application of a voltage to a liquid conversion solution through two pieces of conductive materials to produce final gases. With two pieces of conductive materials immersed in the liquid conversion solution, as anode and cathode, the conductive materials are under direct contact with the liquid conversion solution. Electrons are exchanged between these conductive materials and the liquid conversion solution, and final gases are released as bubbles from the immersed conductive materials. The gases float upward from the liquid conversion solution to the gas chambers above. This prior process is generally not energy efficient.

SUMMARY

Our method provides energy efficient liquid-to-gas conversion using precision manufactured critical surface guided electron exchangers.

DRAWINGS—FIGURES

Figure 1:
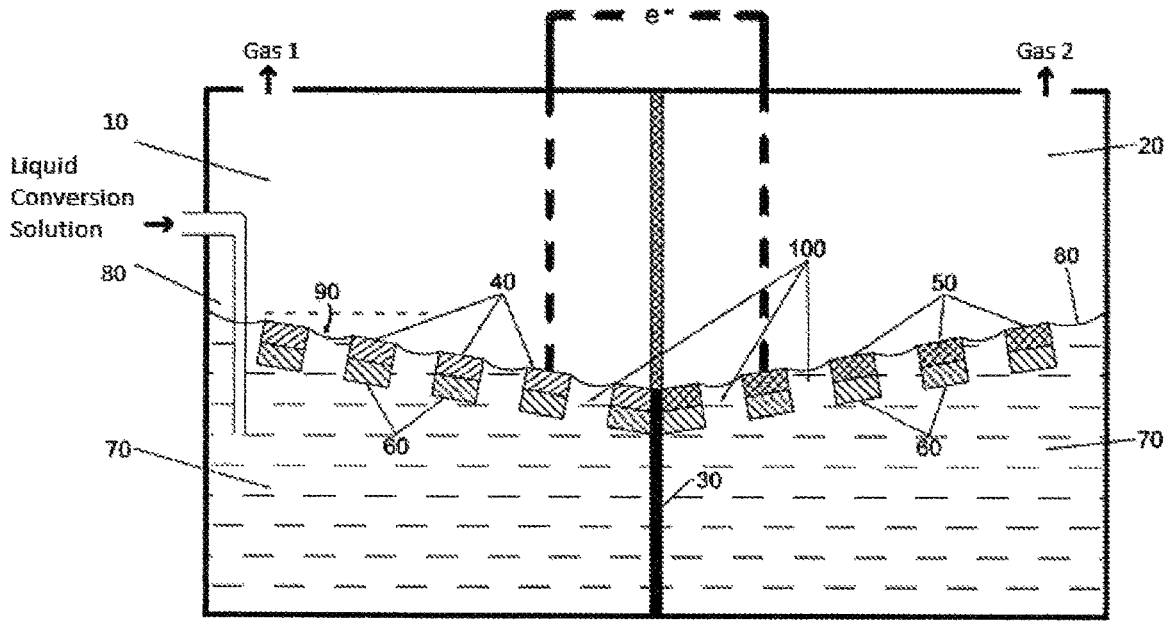

1) FIG. 1: Liquid-to-gas conversion cell with horizontally placed electron exchangers
2) FIG. 2: Liquid-to-gas conversion cell with vertically placed electron exchangers
3) FIG. 3: Stacking of conversion cells horizontally and vertically
4) FIG. 4: Y, star, and circle patterns for puncture channels of electron exchangers

DRAWINGS—REFERENCE NUMERALS

10: Cathode Gas Chamber
20: Anode Gas Chamber
30: Membrane Separator
40: Cathode conductive critical surface of the electron exchanger facing the gas chamber
50: Anode conductive critical surface of the electron exchanger facing the gas chamber
60: Nonconductive side of the electron exchanger
70: Liquid Conversion Solution in Liquid Chamber
80: Excess Gas Outlet
90: Inclined Angle to the Horizontal Line
100: Puncture Channels
210: Cathode Gas Chamber

220: Anode Gas Chamber
230: Membrane Separator
240: Cathode conductive critical surface of the electron exchanger facing the gas chamber
250: Anode conductive critical surface of the electron exchanger facing the gas chamber
260: Nonconductive side of the electron exchanger
270: Liquid Conversion Solution in Liquid Chamber
280: Inclined Angle to the Vertical Line
290: Puncture Channels
310: Conversion Cells

DESCRIPTION:

Our method provides an energy efficient precision manufactured critical surface guided liquid-to-gas conversion.

Electron exchangers in our liquid-to-gas conversion cell can be placed either horizontally or vertically. The electron exchangers are one side conductive and the other side nonconductive. We first describe the horizontal case, see FIG. 1. With the electron exchangers placed horizontally, the conversion cell is divided into an upper gas chamber and a lower liquid chamber. The gas chamber is separated into cathode gas chamber 10 and anode gas chamber 20 by a gas separator, and the liquid chamber 70 is separated by a conversion solution-permeable separation membrane 30 to prevent excess gas from escaping into the wrong gas chamber. The nonconductive sides of the electron exchangers 60 are placed facing downwards towards the liquid chamber and are in contact with the liquid conversion solution. The other conductive sides 40, 50 of the electron exchangers face upwards towards the gas chambers. The electron exchangers are placed at an inclined angle 90 to the horizontal so that gases can be released to the correct gas chambers.

Figure 2:
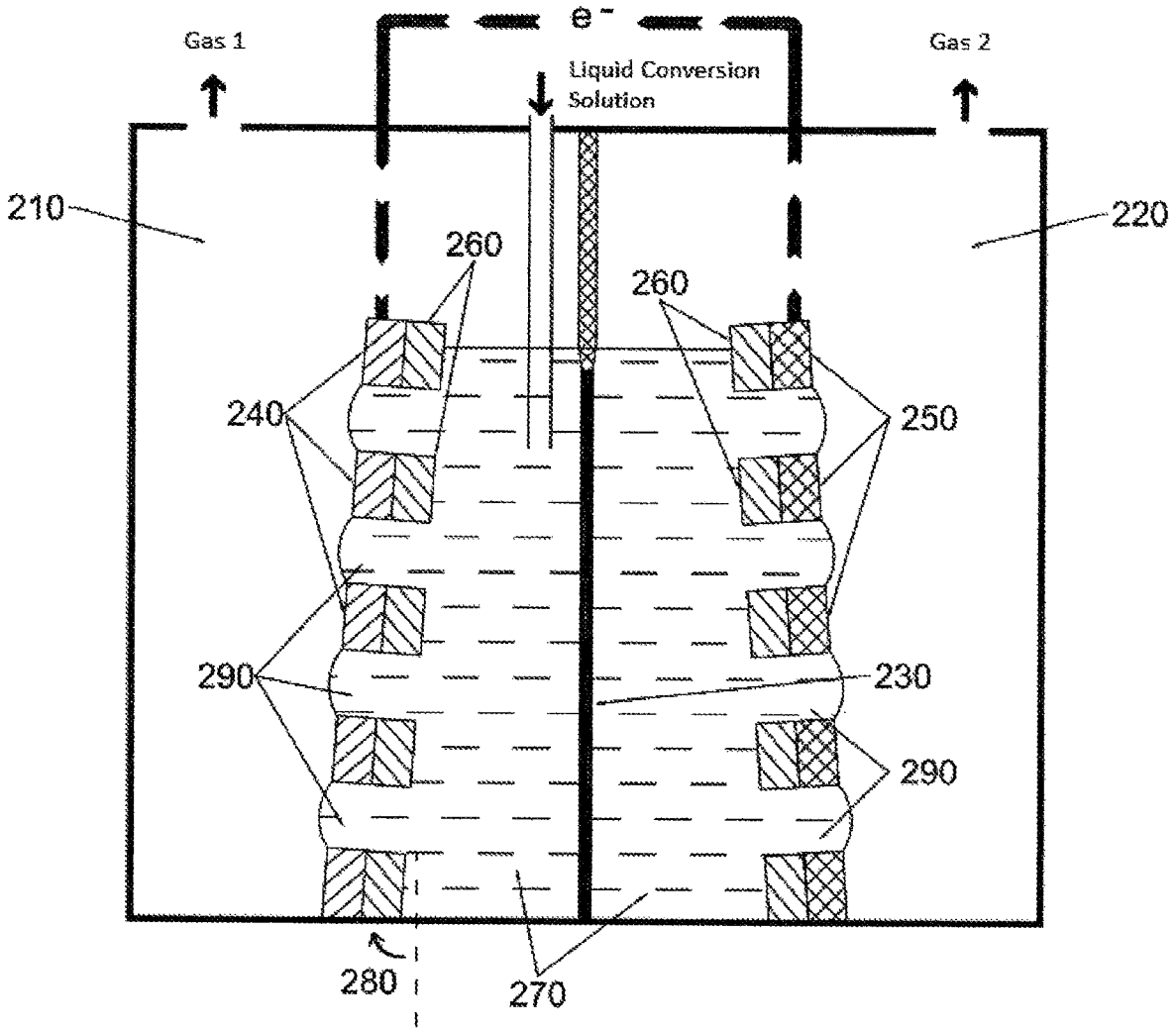

In the alternative design, the anode and the cathode electron exchangers are placed vertically, see FIG. 2. The conversion cell is divided from left to right into the cathode gas chamber 210, the cathode electron exchanger, the liquid chamber 270, the anode electron exchanger, and the anode gas chamber 220. A solution permeable membrane 230 is used to separate the liquid chamber to prevent excess gas from escaping into the wrong gas chamber. The nonconductive sides of the electron exchangers 260 face the middle liquid chamber and are in contact with the liquid conversion solution. The other conductive sides 240, 250 of the electron exchangers face the gas chambers. The electron exchangers are placed at an angle 280 to the vertical line so that gases can be released to the correct gas chambers.

The liquid conversion solution is fed into the liquid chamber, and the liquid conversion solution is added with a solvent to ionize the molecules of the liquid conversion solution. The liquid conversion solution is kept at an appropriate level, so that the liquid conversion solution covers the level of the puncture channels of the electron exchangers. The working temperature of the conversion cell is adjusted approximately close to normal room temperature, and working pressure inside different chambers of the conversion cell are adjusted approximately close to normal sea level atmospheric pressure. The temperature, liquid pressure, and gas pressure at the anode gas chamber, cathode gas chamber, and the liquid chamber are adjusted to improve the output level of gases and the energy efficiency of the conversion cell.

On the nonconductive sides of the electron exchangers facing the liquid conversion solution, there are no electron releases or collection. The electron exchangers are designed with a large number of puncture channels 100 and 290. The liquid conversion solution is pulled by its surface adhesive forces to pass through the puncture channels of the electron exchangers, and reaching the other conductive sides of the electron exchangers facing the gas chambers. The puncture channels are designed to control the rate and amount of liquid reaching the other sides of the electron exchangers. Due to its surface adhesive forces, the liquid conversion solution form a thin film of liquid adhering to the conductive sides of the electron exchangers facing the gas chambers, and do not overflow as liquid into the gas chambers. On the conductive sides of the electron exchangers 40, 50, 240, 250, the surfaces are coated with an electro catalyst and form critical surfaces that exchange electrons with the liquid conversion solution. The liquid conversion solution is converted to gases at the critical surfaces of the conductive sides of electron exchangers, and the gases are directly released to the gas chambers. This set up of the electron exchangers reduces any gas bubble generation at the electron exchangers, and reduces the resistance to electron transfer from one medium to another. It reduces energy barrier and improves efficiency for converting liquid conversion solution to final gases.

The surfaces on the electron exchangers have a large number of puncture channels that are manufactured by a precision technology, comprising: chemical etching, laser drilling or electroforming process. The first option of chemical etching process is applied to a piece of conductive material to etch away specific points of the material to form the puncture channels. The second option of laser drilling is to repeatedly apply a pulsing focused laser to the material to cut away specific spots to form the puncture channels. The third option of electroforming is the fabrication of nanometer or micrometer scale metal devices by electro deposition. The electron exchangers are made by electro depositing specific conductive material onto mandrels to form the puncture channels. After the electron exchangers are made by one of the above processes, they are coated with a nonconductive material on one side, and they are left conductive on the other side.

The various physical parameters and the design of the puncture channels are the key to control the flow of liquid conversion solution to the critical surfaces of the electron exchangers facing the gas chambers, and to enable the formation of a thin film of conversion liquid over the critical surface. The distances between adjacent puncture channels and the radii of the puncture channels are in nanometer or micrometer scale and should be designed by the following method.

The liquid conversion solution stays on the critical surfaces of the electron exchangers as droplets. It diffuses until a partial wetting equilibrium contact radius is reached. For a simple estimation calculation, the droplet radius r can be expressed as:

$$r = \sqrt{\frac{V}{\pi h}}, \text{ where } h = \sqrt{\frac{2\sigma(1-\cos\theta)}{\rho g}}$$

σ is surface tension
g is gravitational acceleration constant
θ is contact angle between liquid and surface
h is height of the droplet
V is time function of volume of the droplet Using a more detailed model, the change in droplet radius over time r(t) can be expressed as:

$$r(t) = r_e\left[1 - \exp\left(-\left(\frac{2\gamma_{LG}}{r_e^{12}} + \frac{\rho g}{9r_e^{10}}\right)\frac{24\lambda V^4(t+t_0)}{\pi^2\eta}\right)\right]^{\frac{1}{6}}$$

By assuming perfect spreading of the droplets, the radius over time r(t) can be expressed as:

$$r(t) = \left[\left(\gamma_{LG}\frac{96\lambda V^4}{\pi^2\eta}(t+t_0)\right)^{\frac{1}{2}} + \left(\frac{\lambda(t+t_0)}{\eta}\right)^{\frac{2}{3}}\frac{24\rho g V^{\frac{3}{2}}}{7\cdot 96^{\frac{1}{3}}\pi^{\frac{4}{3}}\gamma_{LG}^{\frac{1}{3}}}\right]^{\frac{1}{6}}$$

γLG is surface tension of liquid
V is droplet volume
η is viscosity of liquid
ρ is density of liquid
g is gravitational acceleration constant
λ is shape factor, 37.1 m−1
t0 is experimental delay time
re is radius of the droplet at equilibrium Assuming the delay time of approximately 0.1 to 2 seconds in calculating the droplet radius, the distances between adjacent puncture channels are set as approximately 100% to 200% of the droplet radius over time r(t). The radii of the puncture channels should be small enough so that the liquid conversion solution can be pulled by its surface adhesive forces to pass through the puncture channels. The radii of the puncture channels are set as approximately no bigger than radius r. The distances between adjacent puncture channels and the radii of the puncture channels are of different values depending on the locations of the puncture channels on the electron exchangers. In common conversion solution materials, the diameters of the puncture channels can be approximately from 100 nanometers to 100 micrometers. The sizes of the puncture channels can be adjusted based on the applied voltage, operating temperature, liquid pressure, gas pressure, and the desired gas production output level.

The thickness of the puncture channels can be calculated in the following:

The height h of a liquid column is given as $$h = \frac{2\gamma\cos\theta}{\rho g r},$$

γ is liquid-air surface tension coefficient (force/unit length),
Θ is contact angle,
ρ is density of liquid,
g is gravitational acceleration constant, and
r is radius over time r(t).

The thickness of the puncture channels of the electron exchangers are approximately no thicker than h. The thickness of the conductive sides is approximately 100 nanometers to 100 microns in common liquid conversion solution. The thickness of the nonconductive sides should be approximately the same thickness to approximately fifty times the thickness of the conductive sides. The thickness of the nonconductive sides is approximately 100 nanometers to 5 millimeters. The thickness of conductive and nonconductive sides can be adjusted according to the applied voltage, operating temperature, liquid pressure, gas pressure, and the desired gas production output level.

Figure 4:
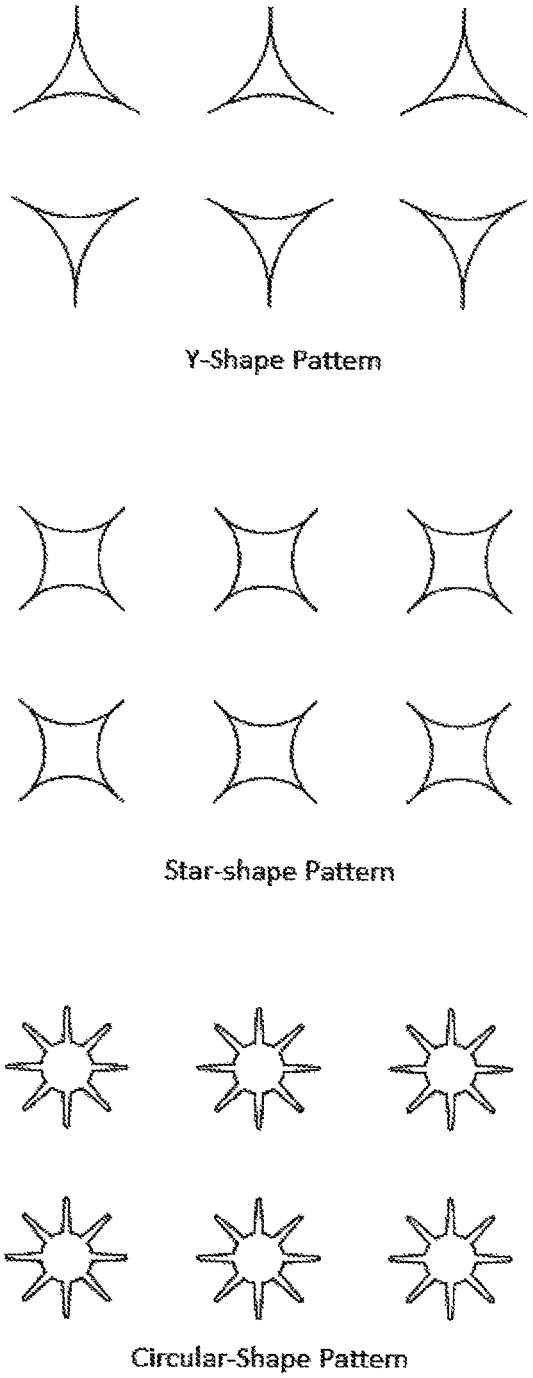

There are a large number of puncture channels on the electron exchangers, and the puncture channels have special designed Y-shaped, star-shaped, and circular-shape patterns, see FIG. 4. These patterns enhance the ability of the liquid conversion solution to adhere to the sides of the electron exchangers facing the gas chambers, and facilitate the electron exchanges for the liquid to gas conversion.

Our method in converting liquid conversion solution into gases is thereby energy efficient in producing the same amount of gases.

Figure 3:
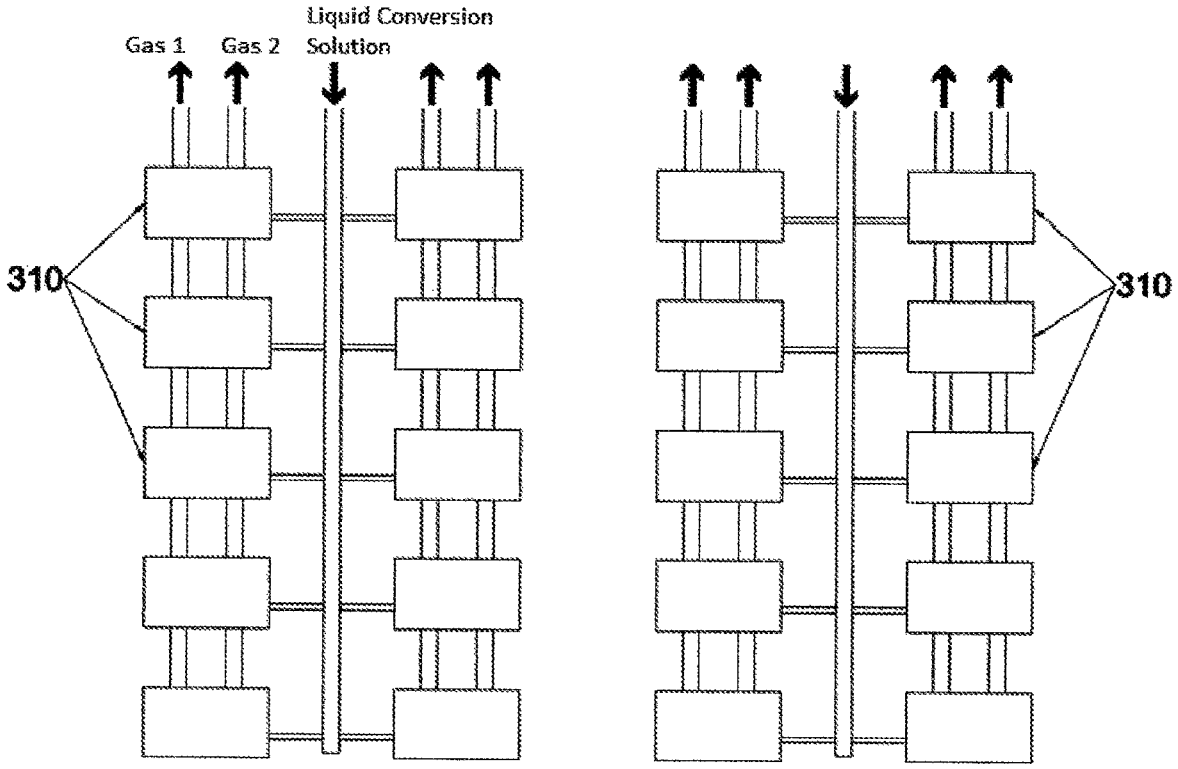

Multiple conversion cells can be stacked vertically and horizontally, see FIG. 3. More conversion cells can be placed in the same physical space to achieve higher gas production, and some common components can be shared across multiple conversion cells.

The conversion cell can also be used to convert many different kinds of liquid conversion solutions into different kinds of gases, and the conversion cell can also be used to convert liquid water into hydrogen gas and oxygen gas.

Operation:

We describe our method using an example of water as liquid conversion solution to generate hydrogen gas and oxygen gas, but the principle of our method can be generalized to apply to other types of liquid conversion solutions to generate other types of gases. The following described embodiment is only one of the, but not all, embodiments of our presented method. Based on the embodiments of our presented method, all other embodiments obtained by those of ordinary skill in the art without creative efforts shall fall within the protection scope of our presented method.

To operate this conversion cell, an electrical voltage is applied to the anode electron exchanger and the cathode electron exchanger. Water is fed into the liquid chamber. Water is ionized by an addition of potassium hydroxide (KOH) or other similar solvents. More water is fed into the liquid chamber as more gases are produced. The water level is maintained at the appropriate level so that water covers the level of the puncture channels of the electron exchangers. Water molecules are pulled by its surface adhesive forces to pass through the puncture channels to reach the sides of the electron exchangers facing the gas chambers. By its surface adhesive forces, water adheres to the sides of the electron exchangers facing the gas chambers, and does not overflow as liquid into the gas chambers. On the sides of the electron exchangers facing the gas chambers, the conductive surfaces are coated with an electro catalyst and they form critical surfaces that exchange electrons with the water. The liquid water is converted to hydrogen gas and oxygen gas at the critical surfaces, and the gases are directly released to the gas chambers.

As a result of applying the electrical voltage, hydrogen gas and oxygen gas are produced into the separate gas chambers, and these gases are directed to other appropriate external space for storage. The result of our conversion cell provides an energy efficient conversion method to generate hydrogen gas and oxygen gas from liquid water.

Conclusion, Ramifications, and Scope:

While the above description contains much specificity, these should not be construed as limitations on the scope of the invention, but rather as an exemplification of one preferred embodiment thereof. Many other variations are possible.

For example, we describe our method using an example of water as liquid conversion solution to generate hydrogen gas and oxygen gases, but the principle of our method can be generalized to apply to other types of liquid conversion solutions to generate other types of gases.

For example, we describe our method in manufacturing the puncture channels using a precision technology, comprising: chemical etching, laser drilling or electroforming process. The puncture channels can possibly be manufactured by other kinds of technologies that are not listed in our described list of technologies, but the principle of our method can be generalized to apply to manufacturing the puncture channels with technologies that are able to create similar small openings.

The described embodiment in the above description is only one of the, but not all, embodiments of our presented method. Based on the embodiments of our presented method, all other embodiments obtained by those of ordinary skill in the art without creative efforts shall fall within the protection scope of our presented method.

The scope of the invention should be determined not by the embodiments illustrated, but by the appended claims and their legal equivalents.

We claim:

1. A method for an energy efficient precision manufactured critical surface guided conversion of liquid to gas, comprising:

placing a liquid conversion solution in a liquid chamber inside a conversion cell;

using electron exchangers, built with one or more puncture channels, in said conversion cell, comprising: cathode electron exchanger, and anode electron exchanger;

setting gas chambers in said conversion cell, comprising: cathode gas chamber, and anode gas chamber;

placing said cathode electron exchanger in between said liquid chamber and said cathode gas chamber inside said conversion cell;

placing said anode electron exchanger in between said liquid chamber and said anode gas chamber inside said conversion cell;

using said electron exchangers with one side conductive and one side nonconductive for said placing of said electron exchangers in said conversion cell;

placing said nonconductive sides of said electron exchangers facing said liquid chamber and in contact with said liquid conversion solution;

placing said conductive side of said cathode electron exchanger facing said cathode gas chamber;

placing said conductive side of said anode electron exchanger facing said anode gas chamber;

applying a voltage to said anode electron exchanger and said cathode electron exchanger; and converting said liquid conversion solution into gases releasing to said gas chambers in said conversion cell.

2. The method of claim 1 wherein said placing said electron exchangers further comprises:

placing said electron exchangers either horizontally or vertically in said conversion cell.

3. The method of claim 2 wherein said placing said electron exchangers horizontally further comprises:

separating said gas chambers into said cathode gas chamber and said anode gas chamber by a gas separator;

placing said nonconductive sides of said electron exchangers facing downwards towards said liquid chamber and in contact with said liquid conversion solution;

placing said conductive side of said cathode electron exchanger facing upward towards said cathode gas chamber;

placing said conductive side of said anode electron exchanger facing upward towards said anode gas chamber; and placing said electron exchangers at an inclined angle to the horizontal level line that is perpendicular to the direction of gravity.

4. The method of claim 2 wherein said placing said electron exchangers vertically further comprises:

placing said electron exchangers vertically dividing said conversion cell, from one side to the other side, into said cathode gas chamber, said cathode electron exchanger, said liquid chamber, said anode electron exchanger, and said anode gas chamber;

placing said nonconductive sides of said electron exchangers facing sideward towards said liquid chamber and in contact with said liquid conversion solution;

placing said conductive side of said cathode electron exchanger facing sideward towards said cathode gas chamber;

placing said conductive side of said anode electron exchanger facing sideward towards said anode gas chamber; and placing said electron exchangers at an inclined angle to the vertical line that is parallel to the direction of gravity.

5. The method of claim 2 wherein said placing said electron exchangers horizontally or vertically further comprises:

said liquid conversion solution passing through said one or more puncture channels of said electron exchangers from said liquid chamber to said conductive sides of said electron exchangers.

6. The method of claim 5 wherein said liquid conversion solution passing through said one or more puncture channels of said electron exchangers further comprises:

said one or more puncture channels controlling rate and amount of said liquid conversion solution in reaching said conductive sides of said electron exchangers;

said conductive sides of said electron exchangers coated with electro catalyst forming critical surfaces;

said liquid conversion solution, due to its surface tension, forming one or more droplets adhering to said critical surfaces of said electron exchangers and controlling said liquid conversion solution not overflowing as liquid into said gas chambers;

exchanging electrons with said liquid conversion solution at said critical surfaces of said conductive sides of said electron exchangers;

converting said liquid conversion solution to said gases at said critical surfaces of said conductive sides of said electron exchangers; and releasing said gases directly to said gas chambers at said critical surfaces.

7. The method of claim 6 wherein said converting said liquid conversion solution to said gases at said critical surfaces of said conductive sides of said electron exchangers further comprises:

adjusting temperature, liquid pressure, and gas pressure inside said anode gas chamber, said cathode gas chamber, and said liquid chamber of said conversion cell to affect said rate and said amount of said liquid conversion solution in reaching said conductive sides of said electron exchangers and to affect said liquid conversion solution forming said one or more droplets adhering to said critical surfaces; and said adjusting said temperature, said liquid pressure, and said gas pressure improving output level of said gases and energy efficiency of said conversion cell.

8. The method of claim 6 wherein said one or more puncture channels controlling rate and amount of said liquid conversion solution in reaching said conductive sides of said electron exchangers further comprises:

making said electron exchangers built with said one or more puncture channels following design parameters.

9. The method of claim 8 wherein said making said electron exchangers built with said one or more puncture channels following said design parameters further comprises:

modeling said liquid conversion solution, due to its said surface tension, forming said one or more droplets adhering to said critical surfaces and diffusing until a partial wetting equilibrium contact radius is reached;

expressing radius r of an adhering droplet of said one or more droplets on an adhered critical surface of said critical surfaces as:

$$r = \sqrt{\frac{V}{\pi h}}, \text{ where } h = \sqrt{\frac{2\sigma(1-\cos\theta)}{\rho g}};$$

σ is said surface tension;

g is gravitational acceleration constant;

θ is contact angle between said adhering droplet and said adhered critical surface;

h is height of said adhering droplet;

V is volume of said adhering droplet;

expressing said adhering droplet with radius over time r(t) as:

$$r(t) = r_e\left[1 - \exp\left(-\left(\frac{2\gamma_{LG}}{r_e^{12}} + \frac{\rho g}{9r_e^{10}}\right)\frac{24\lambda V^4(t+t_0)}{\pi^2\eta}\right)\right]^{\frac{1}{6}}$$

expressing said adhering droplet with radius perfect over time rp(t), by assuming perfect spreading of said adhering droplet and a delay time t, as:

$$r(t) = \left[\left(\gamma_{LG}\frac{96\lambda V^4}{\pi^2\eta}(t+t_0)\right)^{\frac{1}{2}} + \left(\frac{\lambda(t+t_0)}{\eta}\right)^{\frac{2}{3}}\frac{24\rho g V^{\frac{3}{2}}}{7\cdot 96^{\frac{1}{3}}\pi^{\frac{4}{3}}\gamma_{LG}^{\frac{1}{3}}}\right]^{\frac{1}{6}}$$

γ is coefficient of said surface tension;

γLG is term factor of said surface tension;

η is viscosity of said liquid conversion solution;

ρ is density of said liquid conversion solution;

λ is shape factor of said droplet;

t0 is experimental delay time;

re is radius of said adhering droplet at equilibrium;

making distances between an identifiable adjacent pair of said one or more puncture channels as a multiple of said radius over time r(t) or said radius perfect over time r(t);

making radii of said one or more puncture channels no bigger than said radius over time r(t) or said radius perfect over time rp(t);

adjusting said distances between said identifiable adjacent pair of said one or more puncture channels and said radii of said one or more puncture channels to different values depending on locations of said one or more puncture channels on said electron exchangers; and adjusting said distances and said radii of said one or more puncture channels based on said voltage, said output level of said gases, and said temperature, said liquid pressure, and said gas pressure inside said anode gas chamber, said cathode gas chamber, and said liquid chamber of said conversion cell.

10. The method of claim 9 wherein said making radii of said one or more puncture channels no bigger than said radius over time r(t) or said radius perfect over time rp(t) further comprises:

expressing height d of a column of said liquid conversion solution inside a containing puncture channel of said one or more puncture channels as:

$$h = \frac{2\gamma \cos \theta}{\rho g r};$$

x is contact angle between said liquid conversion solution of said column and contact surface inside said containing puncture channel;

making thickness of said one or more puncture channels of said electron exchangers no thicker than said height d;

making thickness of said nonconductive side of said electron exchangers be a multiple of thickness of said conductive side of said electron exchangers; and adjusting said thickness of said conductive side and said nonconductive side of said electron exchangers based on said voltage, said output level of said gases, and said temperature, said liquid pressure, and said gas pressure inside said anode gas chamber, said cathode gas chamber, and said liquid chamber of said conversion cell.

11. The method of claim 8 wherein said making said electron exchangers built with said one or more puncture channels following said design parameters further comprises:

making said one or more puncture channels of said electron exchangers having specific Y-shaped, star-shaped, and circular-shape design patterns;

said design patterns of said one or more puncture channels increasing perimeter length of side edges and increasing side surface areas of said one or more puncture channels, and enhancing said liquid conversion solution adhering to said conducting sides of said electron exchangers; and said increasing in said perimeter length and said side surface areas making more conductive physical space available for said liquid conversion solution to carry out the electron exchange process.

12. The method of claim 11 wherein said making said one or more puncture channels of said electron exchangers having specific Y-shaped, star-shaped, and circular-shape design patterns further comprises:

manufacturing said electron exchangers with high precision said one or more puncture channels for different manufacturing tradeoffs with one or more precision technologies, comprising: chemical etching, laser drilling, or electroforming process, and further comprises:

manufacturing said electron exchangers with said chemical etching by etching away specific points of material to form said one or more puncture channels;

manufacturing said electron exchangers with said laser drilling by repeatedly applying a pulsing focused laser to material to cut away specific spots to form said one or more puncture channels; or manufacturing said electron exchangers with said electroforming process by electro depositing of material onto a mandrel to form said one or more puncture channels.

13. The method of claim 1 wherein said converting said liquid conversion solution into said gases in said conversion cell further comprises: converting one or more different kinds of said liquid conversion solution into two or more different kinds of said gases.

14. The method of claim 13 wherein said converting said one or more different kinds of said liquid conversion solution into two or more different kinds of said gases further comprises:

converting liquid water into hydrogen gas and oxygen gas.

15. The method of claim 1 wherein said converting said liquid conversion solution into said gases in said conversion cell further comprises:

stacking two or more said conversion cells vertically and horizontally; and sharing common components among said two or more said conversion cells.

* * * * *